US007127769B2

(12) United States Patent
Chang et al.

(10) Patent No.: US 7,127,769 B2
(45) Date of Patent: Oct. 31, 2006

(54) TWO-IN ONE CAULK FINISHING TOOL

(76) Inventors: Peter J. Chang, 11001 Petersborough Dr., Rockville, MD (US) 20852; Albert S. Lee, 5916 Perfect Calm Ct., Clarksville, MD (US) 21029

( * ) Notice: Subject to any disclaimer, the term of this patent is extended or adjusted under 35 U.S.C. 154(b) by 695 days.

(21) Appl. No.: 10/617,512

(22) Filed: Jul. 11, 2003

(65) Prior Publication Data

US 2005/0005379 A1 Jan. 13, 2005

(51) Int. Cl.
*A46B 15/00* (2006.01)
*A47L 13/02* (2006.01)

(52) U.S. Cl. ..... 15/105; 15/105.5; 15/236.01; 425/458; D8/19; D8/45

(58) Field of Classification Search ..... 15/105.5, 15/236.01; D8/19, 45
See application file for complete search history.

(56) References Cited

U.S. PATENT DOCUMENTS 3,744,079 A * 7/1973 Krause ..... 15/235.7
5,346,380 A * 9/1994 Ables ..... 425/87
6,067,683 A * 5/2000 Reeves ..... 15/105

* cited by examiner

*Primary Examiner*—David Redding
(74) *Attorney, Agent, or Firm*—Ober/Kaler; Royal W. Craig

(57) ABSTRACT

An improved multi-purpose caulk finishing tool incorporating a clip (or locking slots) for attaching the tool to a caulking gun and means for storing caps for caulking material. The present invention is held and carried unobtrusively on a conventional caulking gun. Means are also provided for storing caps, for resealing caulking material cartridges, within the caulk finishing tool.

16 Claims, 8 Drawing Sheets

TWO-IN ONE CAULK FINISHING TOOL

BACKGROUND OF THE INVENTION

1. Field of the Invention

The invention relates to an improved caulk finishing tool and particularly to a caulk finishing tool which is adapted to attach to a caulking gun for ready availability and which is adapted to provide a cap for resealing cartridges of caulking material.

2. Description of the Background

In building construction and repair, caulking material is commonly used for sealing joints. On the exterior of buildings, joints are made weatherproof by caulking. On the interior of buildings, especially in kitchens and bathrooms, joints are sealed by caulking to prevent water penetration. There are many and varied construction materials including concrete, wood, glass, tile, etc. The joints to be sealed often occur between unlike materials. Consequently, the caulking is available in many different formulations so that an appropriate one can be selected to adhere properly in any given situation. Typically, caulking material is provided in uniformly sized cartridges, having a nozzle at one end and a movable end piece at the other end. The caulking material is applied with a caulking gun, which is adapted to receive and hold the cartridge and has a ratchet driven push rod to force the movable end piece into the cartridge and toward the nozzle. The parallel or "open" frame caulking gun has a pair of rails connecting a front and a rear portion of the caulking gun. The front portion includes a stop for preventing the cartridge of caulking material from sliding when pressure is applied from the rear and the rear portion includes the ratchet drive mechanism.

Alternatively, the cradle or "half-barrel" design caulking gun has a half-cartridge-shaped cradle connecting the front and rear portions. The push rod protrudes from the rear portion of the caulking gun and normally has a right angle bend, at the distal end, to facilitate pulling the rod from the cartridge, after the caulk material has been expended. Some models include a curved ladder hook, so that the caulking gun may be hung from a ladder rung or other support. In either case, the caulking material comes in an airtight sealed cartridge, to preserve its content and prevent premature drying. The cartridge is opened by cutting the nozzle end and puncturing the seal inside the nozzle with a sharp nail or wire. The end of the nozzle may be cut in a variety of ways to produce a bead of caulking material of a desired size. When the ratchet drive mechanism is advanced, the caulking material is delivered through the nozzle.

When caulking, a variety of other tools are commonly used. For example, areas which require caulking often occur at right angle joints and the caulking material is applied first by using the caulking gun to deposit a bead of caulking material along a section of the joint. Afterward, a finishing tool is used to press the bead into the joint and to skim away the excess caulking material. One existing finishing tool is designed with two flanges joined at an oblique angle, which is slightly greater than 90°.

The tool can be pressed into the joint and moved along the bead of caulking material. The tool presses the caulking material into the joint, for a thorough seal, smoothes the surface and removes the excess caulking material, all in one step. In addition, the tool will not disfigure the surfaces adjacent to the joint.

U.S. Pat. No. 3,744,079, to Krause, is an example of a caulk finishing tool of this type, and FIG. 1 herein depicts the '079 tool. Unfortunately, this tool is relatively small, must be carried separately from the caulk gun, and is often lost or misplaced. Moreover, it is common for a workman to arrive at the top of his ladder only to realize that he must descend to retrieve his caulk finishing tool. In addition, once a particular area has been caulked, it is desirable to cap the cartridge to prevent drying of the unused portion. Cartridges of caulking material are generally not provided with means to cap the nozzle, after it has been cut. Plastic caps are available to snap on to the cartridge for sealing the contents, and these typically have a protruding central portion to accommodate the nozzle, and a circular gripping rim. Again, if a workman intends to climb a ladder, caulk a particular area and remain on the ladder to perform some other work, all of the caulking gun and cartridge, the finishing tool, and spare plastic caps must be gathered together and carried up the ladder. For the foregoing reasons, it has long been recognized the of advantage of constructing a multi-purpose tool that can carry the number of separate small tools to a work site and kept within reach during the work. These innovations avoid the necessity of carrying separate tools, misplacing or losing them. This is a great advantage when a workman must climb a ladder to reach the place where caulking material is to be applied. There have been previous caulking guns constructed with an attached rod which can be used to dislodge dried caulking material from the nozzle of the cartridge. However, such rods are not an acceptable substitute for a tool such as shown in the above-described '079 patent. Moreover, no known caulking guns have the ability to dispense or provide a cap for the unspent caulk cartridges.

It would be greatly advantageous to provide an effective caulk finishing tool which removably attached to standard open frame or half-barrel type caulking guns, and which has the dual capacity to dispense or otherwise provide a nozzle cap for the unspent caulk cartridges, all in one convenient readily-accessible tool.

SUMMARY OF THE INVENTION

It is an object of the present invention to provide an improved caulk finishing tool with the dual capacity to dispense or otherwise provide a nozzle cap for the unspent caulk cartridges. It is another object of the present invention to provide an improved caulk finishing tool which removably attaches to standard open frame or half-barrel type caulking gun and remains on the caulking gun while it is being transported, stored and while it is in use. It is a further object of the present invention to provide an improved caulk finishing tool with integral compartment for storing a plurality of spare caulk cartridge caps.

In accordance with the stated objects, there is provided a dual-purpose caulk finishing tool incorporating an attachment clip for attaching the tool to a caulking gun and a capping feature for resealing cartridges of caulking material, thereby adding convenience and saving time. The caulk finishing tool generally comprises an elongated square tubular member having an open front end that tapers to an apex and serves as a scoop and/or tamping tool for caulk, whereby residual caulk can be conveniently removed. An integral clip is mounted on the outer surface of the caulk finishing tool for attaching the caulk finishing tool comfortably between the rail and push-rod of the parallel frame gun and between the edge of the barrel wall and the push-rod of the half-barrel gun, so as not to be obstructive in packing, storing and transporting. Alternately, the clip can be reoriented for attachment to either the ladder hook of an existing caulk gun or to the internal plunger rod (both of these items being typically formed of a unitary length of steel rod).

Yet another alternative in lieu of the clip is to form locking slots on the outer surface of the caulk finishing tool, the locking slots being defined by round holes joining narrower slots for insertion and snapping into place corresponding screws on the frame of the parallel frame gun. The back end of the caulk finishing tool is adapted to form a compartment for storage of spare caps for capping cartridges of caulking material. Internal ribs or walls are provided for maintaining the caps in position, and the back end includes a removable closure with a visual see-through hole for gaining access thereto. In the event that a worker needs to seal a partially used cartridge of caulking material, for a period of time, a cap can be removed from the back end of the tool of the present invention and secured over the nozzle of the caulk cartridge. Alternatively, a capping structure is integrally-molded to the back end of the tubular member so that the tool itself serves as a cap.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

The present invention is an improved dual-purpose caulk finishing tool 2 incorporating an attachment clip for attaching the tool to a caulking gun and a capping feature for resealing cartridges of caulking material. The improved caulk finishing tool 2 adds convenience and saves time.

Figure 1:
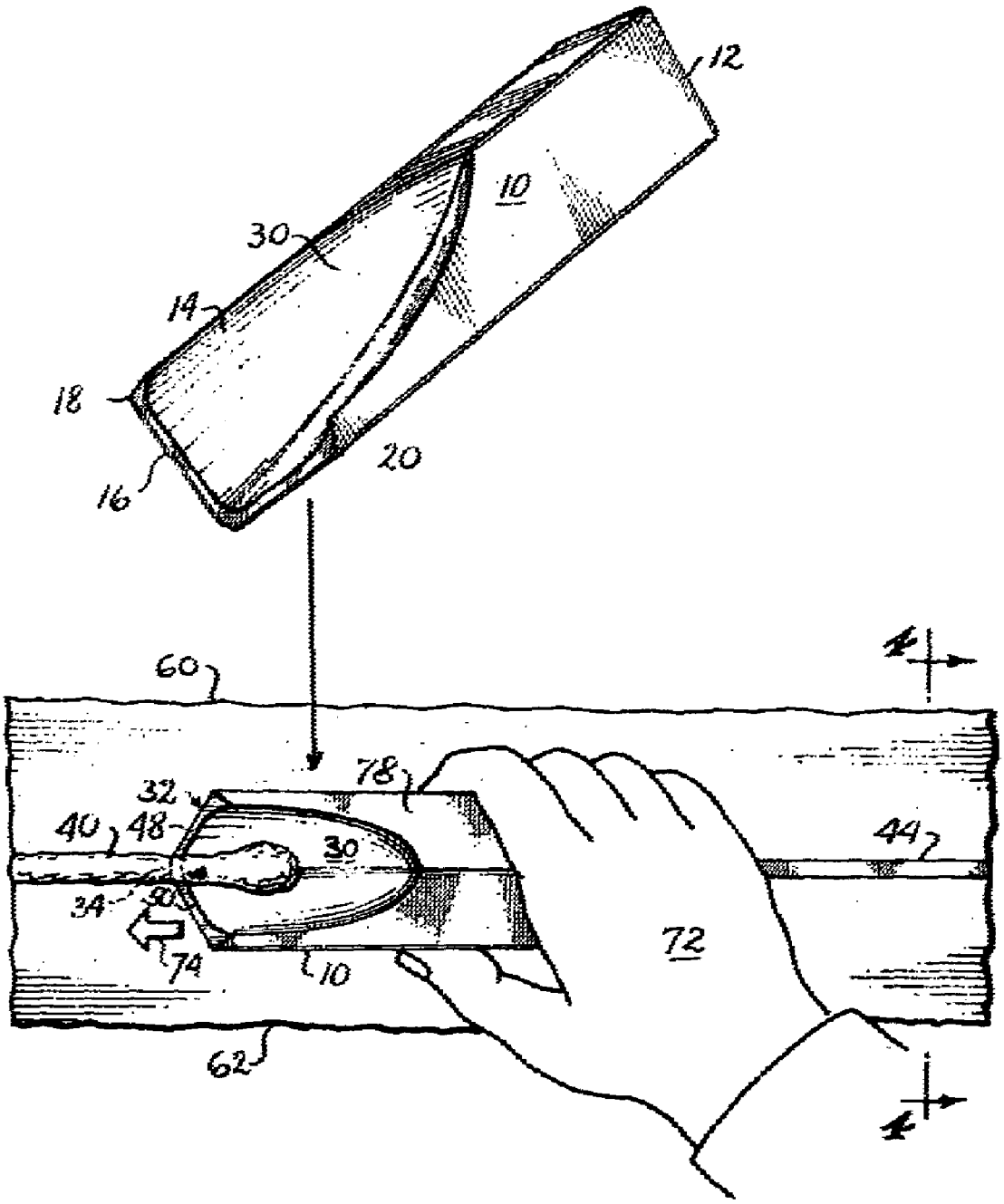
FIG. 1 (Prior Art)
FIG. 1 is a caulk finishing tool of the prior art as described in U.S. Pat. No. 3,744,079.
Figure 2:
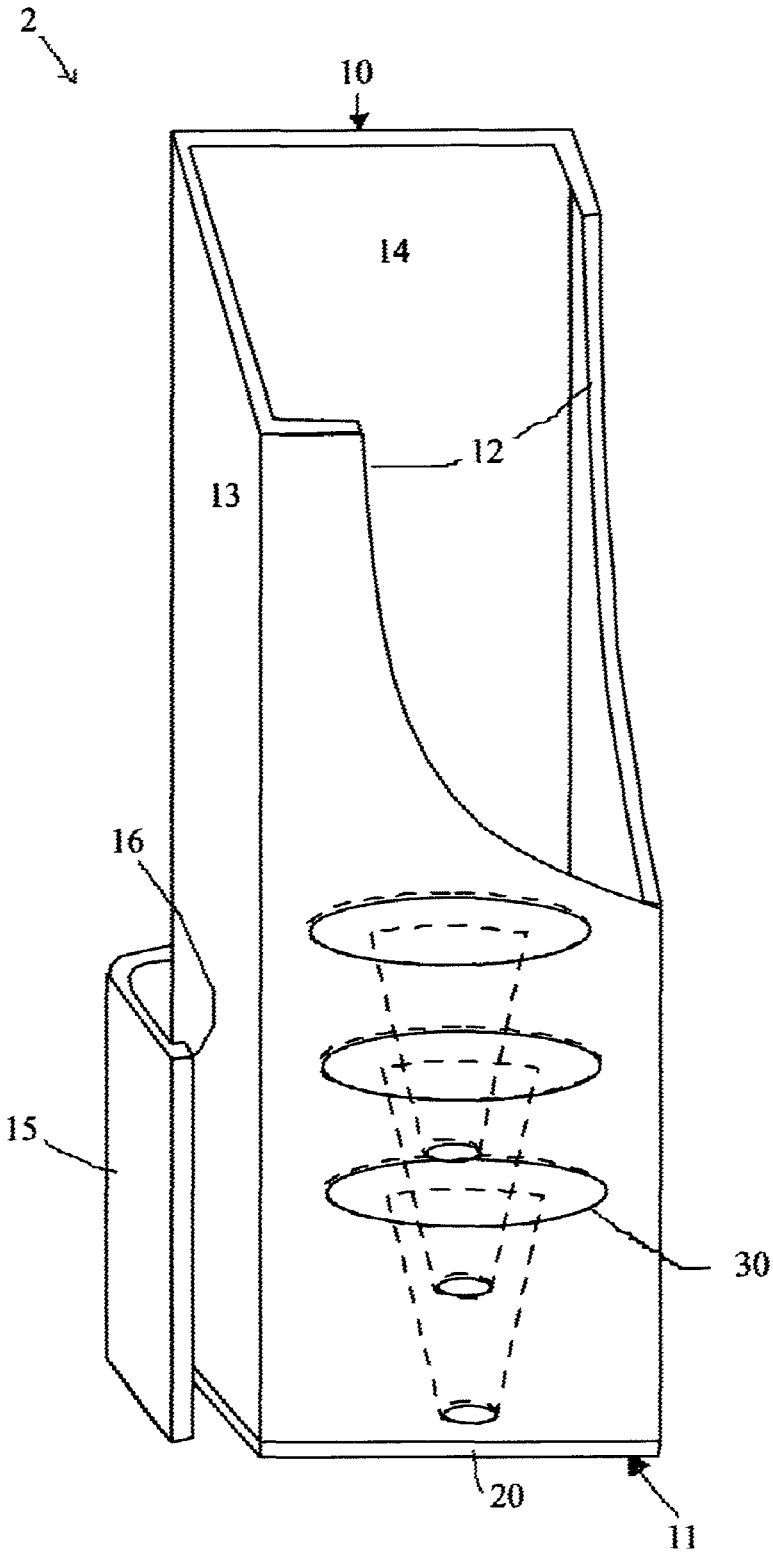
FIG. 2 is a perspective view of the caulk finishing tool 2 of the present invention.

The caulk finishing tool 2, as shown in FIG. 2, generally comprises an elongated square tubular member having an open front end 10 and a closed back end 11. The open front end is the operative end for caulk finishing. The substantially square walls of the open front end 10 are tapered rearwardly from one corner thereof to define an open-topped chamber with opposing flanges 12. The entire caulk finishing tool 2 may be molded of rugged plastic, PVC or like material. The flanges 12 extend to solid walls 13, 14, which join each other at a 90 degree angle to define an apex at the front end 10. The apex serves as a scoop and/or tamping tool for caulk, and residual caulk can be conveniently removed through the recess of the tapered opposing flanges 12. This configuration is particularly useful in applying a caulk bead to (or removing an old caulk bead from) a joint, where walls meet at a right angle. Specifically, a bead of caulk material is applied in a joint with a caulking gun. The caulk finishing tool 2 is then pressed onto the bead of caulking material and moved along the joint to press the caulking material inside and to skim away excess caulking material, all in one motion. The tool 2 conforms to the joint and produces a smooth caulk bead without abrading the adjacent walls.

Figure 3:
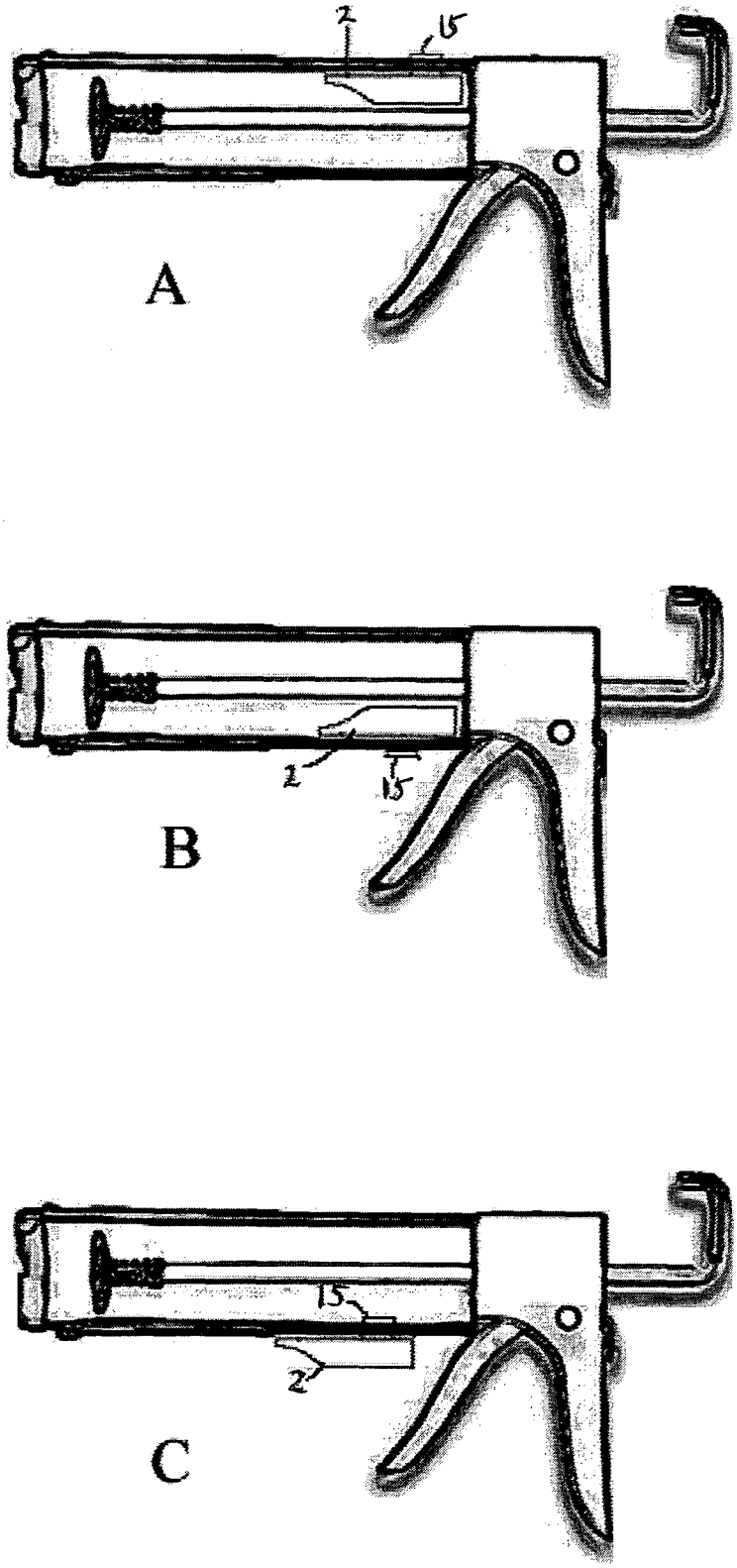
FIGS. 3A–C are a side view of caulking finishing tool as in FIG. 2 attached to within and out of the frame, respectively, to an open frame gun.
FIGS. 3D & 3E are a side view of the caulking finishing tool as in FIG. 2 attached within and out of the half barrel, respectively, to a half-barrel gun.
Figure 3:
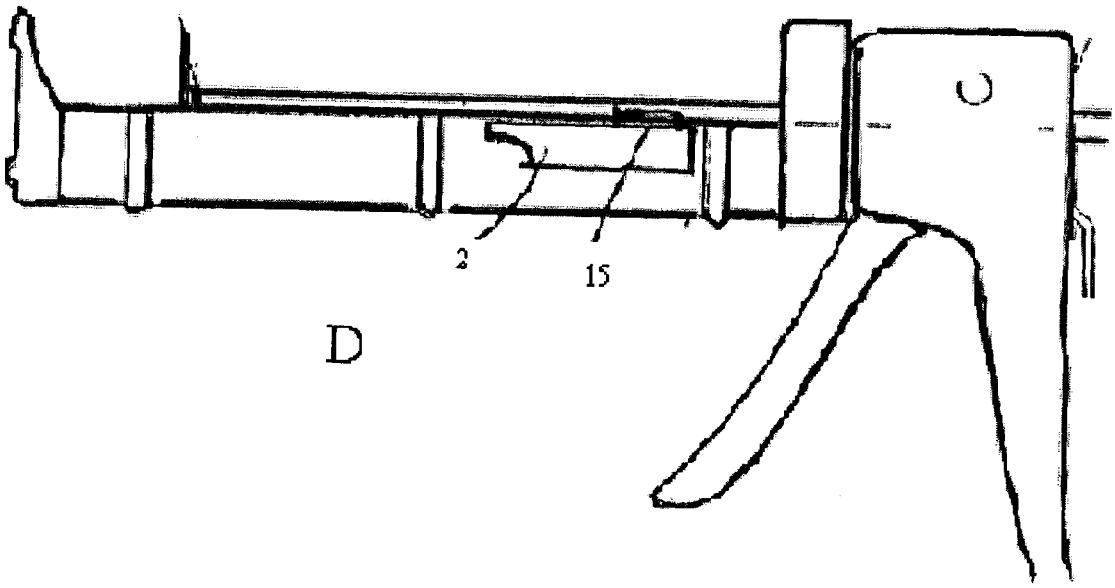
Figure 3:
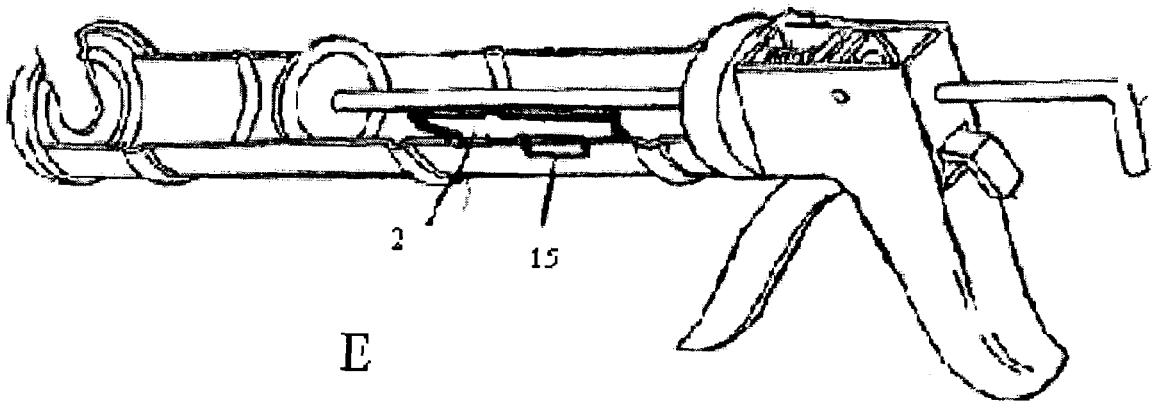
Figure 4:
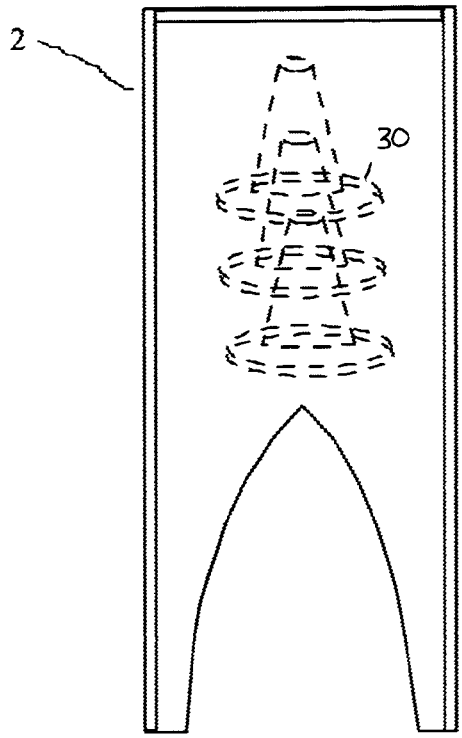
FIG. 4 is a side cross-section view of the caulk finishing tool 2 as in FIGS. 2 and 3.
Figure 5:
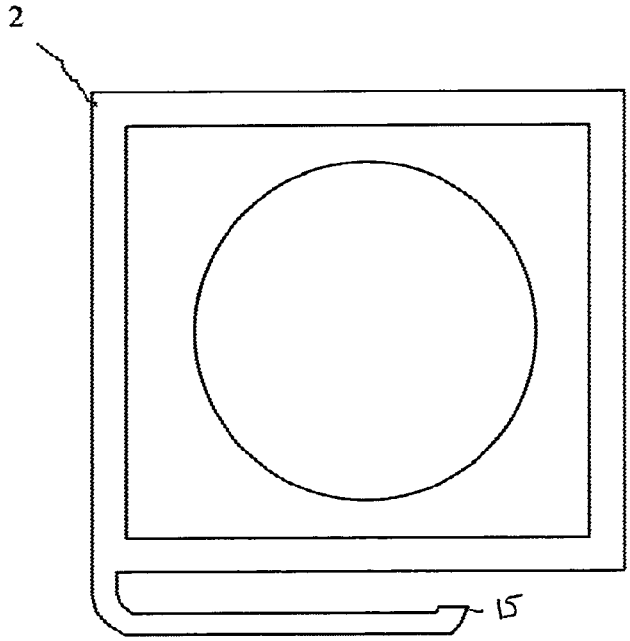
FIG. 5 is a back view of the removable closure of caulk finishing tool 2 as in FIGS. 2–4 with a see-through hole.

FIG. 4 is a side cross-section view of the caulk finishing tool 2 as in FIG. 2, and FIG. 5 is a front cross-section view of the caulk finishing tool 2. As best seen in FIGS. 2 and 5, an integral clip 15 is mounted on the outer surface of the caulk finishing tool. In the preferred embodiment, the clip 15 is formed of the same material and may be integrally molded to either wall 13, 14 of the caulk finishing tool 2 and extends outward a short distance, and then perpendicular to the wall for a distance slightly greater than the width of a rail on a standard parallel frame caulking gun (or the width of the edge of the barrel on the half-barrel gun). Preferably, the edge of clip 15 is formed with an inwardly protruding catch 16 to prevent falling off. The clip 15 defines a narrow space (0.5–3 mm) for a friction fit on the rail of a parallel frame caulking gun or the barrel edge of the half-barrel gun. The clip 15 is oriented so that the caulk finishing tool 2 will attach to a parallel frame caulking gun such that the elongate tubular length lies parallel to the rails of the caulking gun, as shown in FIGS. 3A–C. The caulk finishing tool 2 is dimensioned to fit between the rail and push-rod of the parallel frame gun, and will not be obstructive in carrying, storing and transporting the gun. It is intended that the clip 15 may be slideably disposed along the rail of the parallel frame caulking gun or so that the caulk finishing tool 2 can be repositioned either on top of the upper rail as in FIG. 3A, on top of the bottom rail as in FIG. 3B, or under the bottom rail as in FIG. 3C while the gun is in use. Alternatively, the clip 15 may be oriented to attach to a half-barrel caulking gun such that the elongate tubular length lies outside the barrel as shown in FIG. 3D when the gun is in use, or outside the barrel as shown in FIG. 3E for storage. Again, the caulk finishing tool 2 is dimensioned to fit between the barrel and push-rod of the half-barrel gun. It is anticipated that the caulking gun would be used, with the caulk finishing tool 2 attached, to apply a bead of caulking material, and then the caulk finishing tool 2 would be detached and used to smooth the bead of caulking material. After smoothing the bead, the caulk finishing tool would be reattached to the rail. It is also anticipated that the clip 15 of the caulk finishing tool can be reoriented for attachment to the ladder hook of caulking guns, thereby allowing it to be used with other types of guns.

Figure 6:
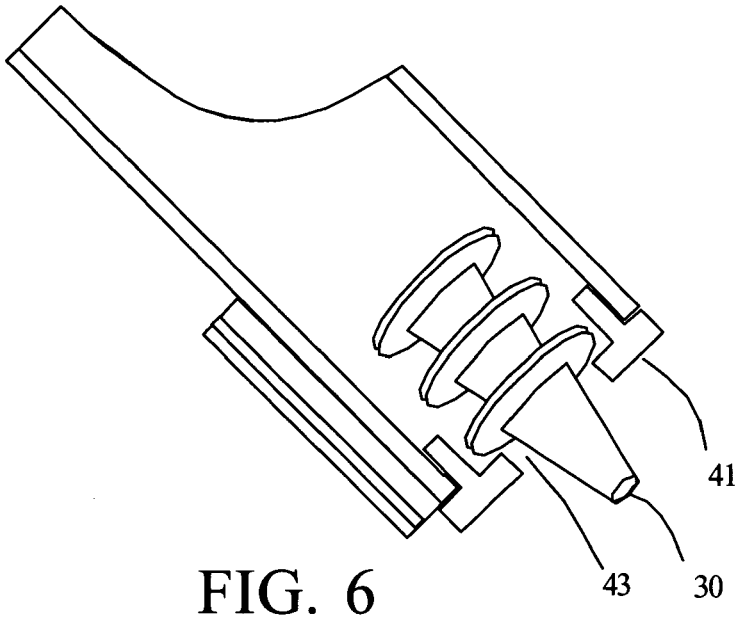
FIG. 6 is tilted position of caulk finishing tool, illustrating the cone of the cap 30 popping out through the see-through hole 43.
Figure 7:
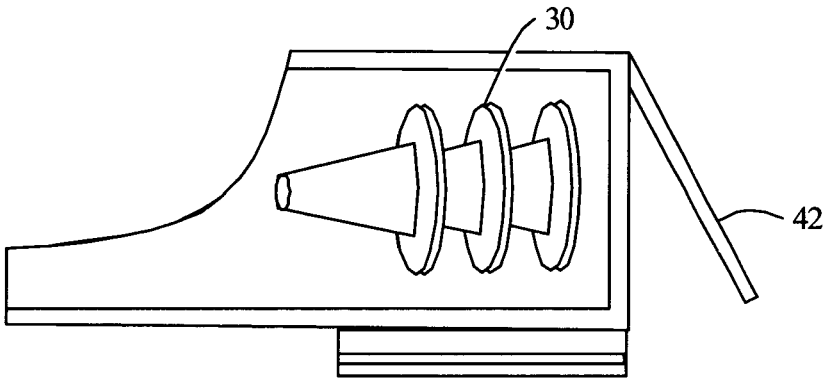
FIGS. 7–8 illustrate two alternative configurations of the back enclosure feature, including a plurality of spare caps enclosed in a cap compartment with a hinged closure (FIG. 7), and an integral capping structure (FIG. 8).

The back end 11 of the caulk finishing tool 2 is adapted to provide a capping feature for capping cartridges of caulking material Referring collectively to FIGS. 6–7, the back end 20 of the caulk finishing tool 2 is adapted to form a compartment for storage of spare caps 30 for capping cartridges of caulking material. Conventional caps 30, for resealing the nozzle of a cartridge, are approximately 1.5 inches in length and 0.75 inches in diameter. The chamber of the caulk finishing tool adjacent to the back end 11 is hollow and encloses a stacked array of two or three caps 30. Internal ribs or walls are provided for maintaining the caps in position, and the back end 11 includes a removable closure 41 for gaining access thereto.

FIG. 6 illustrates one embodiment of the capping feature with closure 41 provided with a see-through hole 43. The caulk finishing tool 2 is shown in a 45 degree tilted position, in which the cone of cap 30 drops out of the see-through hole 43 on the back closure 41 for easy access of the cap and for a visual availability check. When needed, cap 30 is manually pulled out by its cone through the hole 43 in the back of closure 41. Moreover, when a refill of caps 30 is needed, hole 43 helps in removing closure 41 inasmuch as it is possible to hook one's finger through the hole 43 for pulling.

FIG. 7 illustrates an alternative configuration with a hinged closure 42 integrally molded along one side to the back end 20 of the caulk finishing tool 2 for a pivoting snap-fit closure. In either case, should a worker wish to set aside a partially used cartridge of caulking material, a cap 30 can be easily removed, from the storage space within the caulk finishing tool and used to reseal the cartridge.

Using the embodiments of FIG. 6 or 7, in the event that a worker needs to seal a partially used cartridge of caulking material, for a period of time, a cap can be removed from the back end 11 of the tool 2 and secured over the nozzle of the caulk cartridge.

Figure 8:
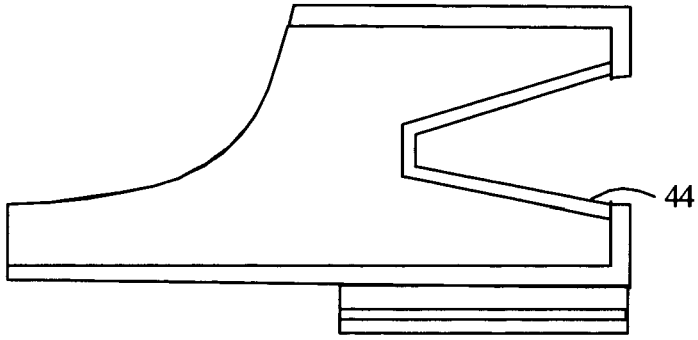

Alternatively, a capping structure may be integrally-molded to the back end 11 so that the tool 2 itself serves as a cap. FIG. 8 illustrates an integral capping structure 44. In this instance, the back end 20 of the caulk finishing tool 2 remains open and capping structure 44 is integrally-molded to the side walls of the caulk finishing tool 2, providing a tapered inward opening similar to that of a conventional cap. This way, the caulk finishing tool 2 itself serves as the cap. In use, the caulk finishing tool may be pressed rearwardly onto partially used cartridge of caulking material, back end 11 first, to seal the contents.

The foregoing improvements provide an effective caulk finishing tool 2 which removably attaches to either standard open frame or half-barrel type caulking guns, and which has the dual capacity to dispense or otherwise provide a cap for the unspent caulk cartridges, all in one convenient readily-accessible tool.

Figure 9:
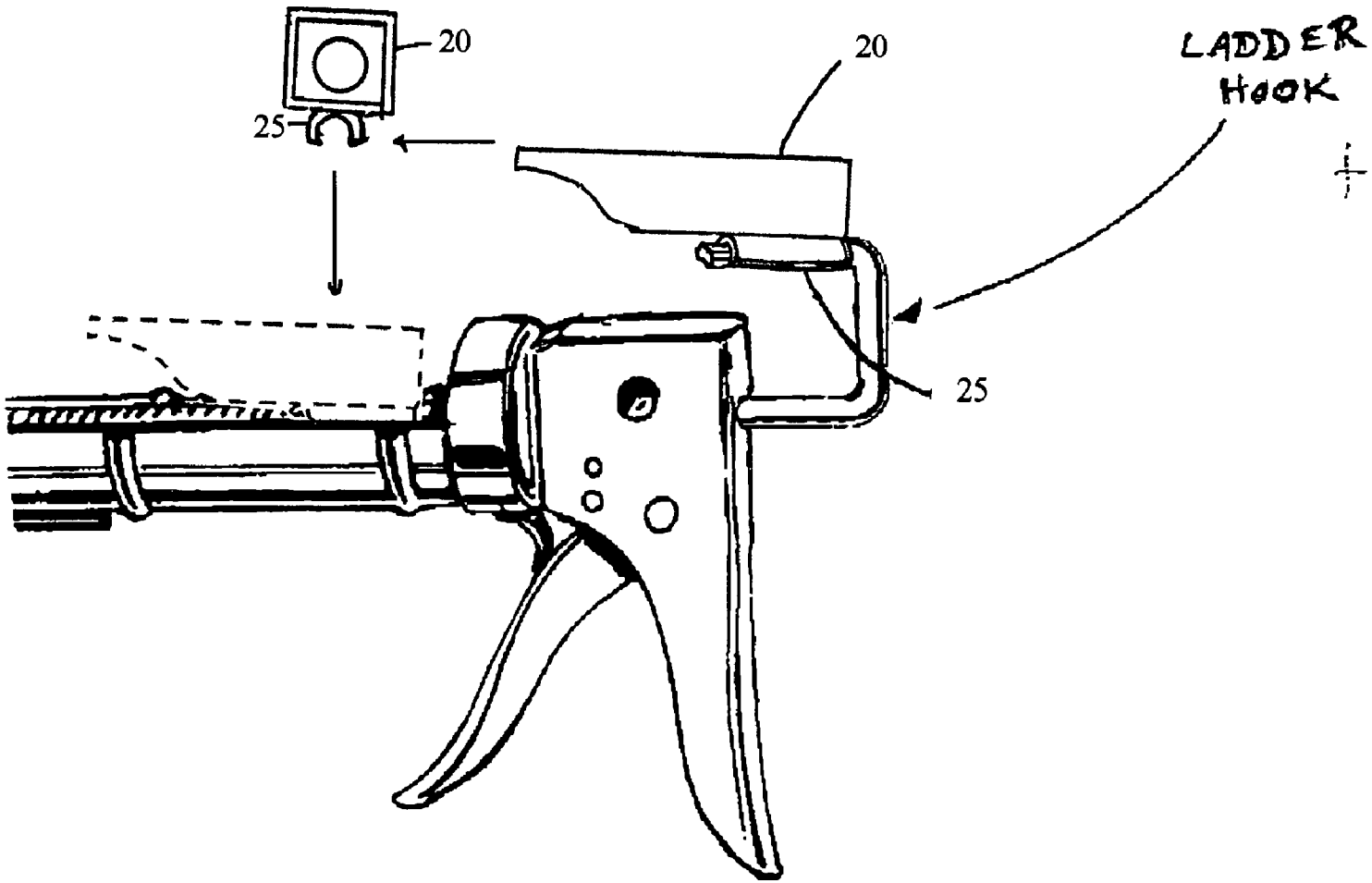
FIG. 9 is a side view of a caulk finishing tool similar to that of FIG. 2 but with an alternate clip configuration suited for attachment to either the ladder hook of an existing caulk gun or to the internal plunger rod.

FIG. 9 is a side view of a caulk finishing tool 20 similar to that of FIG. 2 but with an alternate downwardly-oriented clip 25 configuration more suited for attachment to the plunger rod and/or ladder hook of a caulk gun. The downwardly-oriented clip 25 comprises an open hemispherical downwardly-open clip which is preferably integrally-molded to tool 20 and dimensioned to clip onto either the existing ladder hook of an existing caulk gun or to the internal plunger rod (both of these items being typically formed of a unitary length of steel rod). In practice, the finishing tool 20 can be inserted onto the plunger rod (partially enclosed within the frame of an open frame gun or within the half barrel gun) while in transportation or storage as shown in dotted lines, and on the ladder hook as shown at right while the gun is in use.

Figure 10:
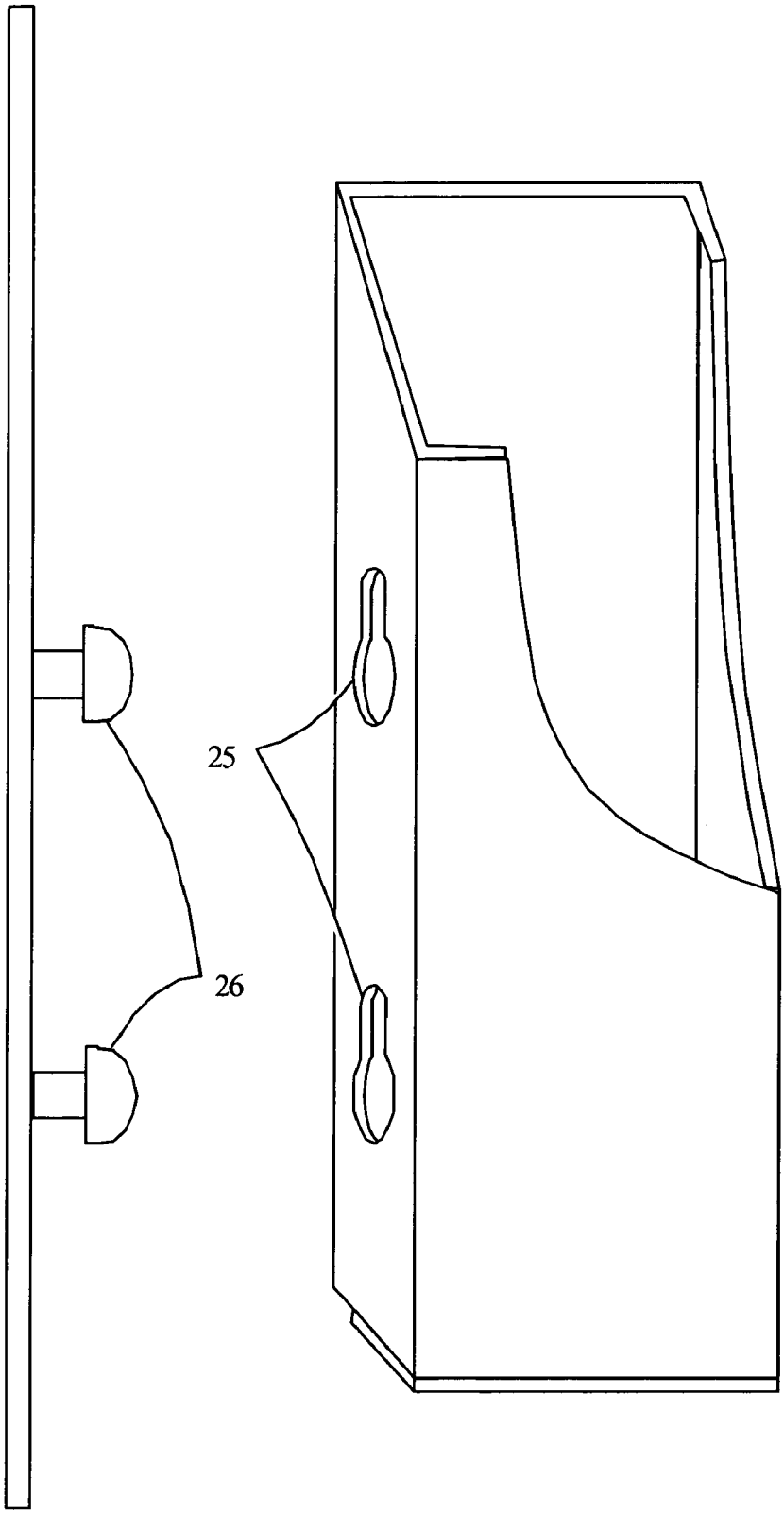
FIG. 10 is side view of alternative method of attaching the caulk finishing tool to the rail of the parallel frame gun.

Another alternative in lieu of the clips 15, 25 is to form locking slots on the outer surface of the caulk finishing tool for insertion onto mating screws on the caulk gun. As shown in FIG. 10, the locking slots 25 are defined by round holes joining narrower slots for insertion and snapping into place corresponding screws 26 on the frame of the parallel frame gun, so that the caulk finishing tool 2 can be tightly snapped into place by the slot 25.

Having fully disclosed the improvements of the present invention, it will be understood that certain variations of the form and structure may be made without departing from the scope of the invention.

We claim:

1. A caulk finishing tool, comprising:

an elongate tubular member having an open front end and back end, the walls of the open front end being tapered rearwardly from an apex to define an open-topped workpiece for caulk finishing;

a clip mounted on the outer surface of said elongated member, for removably attaching said caulk finishing tool to a caulking gun; and a removable closure covering the back end of said elongated tubular member for storing a plurality of caulk cartridge caps therein.

2. The caulk finishing tool according to claim 1, wherein said clip comprises a flat plate spaced apart from an outer surface of said tubular member and defining a space there between and accessible laterally for receiving and holding a rail of a parallel frame caulking gun and barrel wall of a half-barrel caulking gun.

3. The caulk finishing tool according to claim 2, wherein said caulk finishing tool is adapted to be seated between said rail and push-rod of the parallel frame caulking gun and between a barrel wall and push rod of a half-barrel caulking gun.

4. The caulk finishing tool according to claim 1, wherein said clip comprises an open hemispherical downwardly-open clip for attachment to a ladder hook of an existing caulk gun and to an internal plunger rod of said caulk gun.

5. The caulk finishing tool according to claim 1, wherein said closure is a removable closure that snaps atop the back end of the caulk finishing tool to contain caps therein.

6. The caulk finishing tool according to claim 5, wherein said closure is defined by a see-through hole through which caps are dispensed, and to serve as a pull handle for removal of said closure.

7. The caulk finishing tool according to claim 1, wherein said closure is a hinged closure integrally molded to the caulk finishing tool for a pivoting snap-fit atop the back end of the caulk finishing tool to contain caps therein.

8. A caulk finishing tool, comprising:

an elongated tubular member having an open front end and back end, the walls of the open front end being tapered rearwardly from an apex to define an open-topped workpiece for caulk finishing;

a clip mounted on the outer surface of said elongated member, for removably attaching said caulk finishing tool to a caulking gun; and an integral capping structure formed in the back end of said tubular member and defining a tapered inward opening to serve as a cartridge cap.

9. The caulk finishing tool according to claim 8, wherein said clip comprises a flat plate spaced apart from an outer surface of said tubular member and defining a space there between and accessible laterally for receiving and holding a rail of a parallel frame caulking gun.

10. The caulk finishing tool according to claim 9, wherein said caulk finishing tool is seated between said rail and push-rod of a parallel frame caulking gun.

11. The caulk finishing tool according to claim 8, wherein said clip comprises an open hemispherical downwardly-open clip for attachment to a ladder hook of an existing caulk gun and to an internal plunger rod of said caulk gun.

12. The caulk finishing tool according to claim 8, wherein said closure is a removable closure that snaps atop the back end of the caulk finishing tool to contain caps therein.

13. The caulk finishing tool according to claim 8, wherein said closure is a hinged closure integrally molded to the caulk finishing tool for a pivoting snap-fit atop the back end of the caulk finishing tool to contain caps therein.

14. A caulk finishing tool, comprising:

an elongate square-tubular member having an open front end and a back end, the walls of the open front end being tapered rearwardly from an apex to define an open-topped workpiece for caulk finishing;

means for removably attaching said caulk finishing tool to a caulking gun; and a closure covering the back end of said elongated tubular member for storing a plurality of caulk cartridge caps therein.

15. The caulk finishing tool according to claim 14, wherein said attaching means comprises a clip mounted on an outer surface of said elongated member.

16. The caulk finishing tool according to claim 14, wherein said attaching means comprises locking slots in an outer surface of said elongated member, and corresponding anchors protruding from said caulking gun for insertion in said locking slots.

* * * * *